United States Patent [19]

D'Angelo

[11] Patent Number: 5,067,775

[45] **Date of Patent: * Nov. 26, 1991**

[54] RETAINER FOR ROTATABLE BITS

[75] Inventor: Mark D. D'Angelo, Bedford, Pa.

[73] Assignee: Kennametal Inc., Latrobe, Pa.

[ * ] Notice: The portion of the term of this patent subsequent to Dec. 26, 2006 has been disclaimed.

[21] Appl. No.: 184,511

[22] Filed: Apr. 21, 1988

[51] Int. Cl.[5] ..... E21C 35/18

[52] U.S. Cl. ..... 299/86; 299/92

[58] Field of Search ..... 299/79, 86, 91, 92, 299/93; 175/354

[56] References Cited

U.S. PATENT DOCUMENTS

| | | | |
|---|---|---|---|
| Re. 29,900 | 3/1970 | Kniff . | |
| 1,250,525 | 12/1917 | Sunderland . | |
| 1,337,642 | 4/1920 | Clark . | |
| 1,831,765 | 11/1931 | Gouverneur . | |
| 2,067,271 | 1/1937 | Johnson et al. . | |
| 2,410,875 | 12/1946 | Segal . | |
| 3,413,030 | 11/1968 | Drake . | |
| 3,820,848 | 6/1974 | Kniff . | |
| 3,830,321 | 8/1974 | McKenry et al. . | |
| 4,065,185 | 12/1977 | Elders . | |
| 4,149,753 | 4/1979 | Stoltz et al. | 299/86 |
| 4,343,516 | 8/1982 | Aden . | |
| 4,582,364 | 4/1986 | deMey, III . | |
| 4,678,238 | 7/1987 | Emmerich . | |
| 4,684,176 | 8/1987 | DenBesten et al. . | |
| 4,743,069 | 5/1988 | Ojanen | 299/86 |
| 4,755,003 | 7/1988 | Pinkerton | 299/86 |
| 4,763,956 | 8/1988 | Emmerich | 299/86 |

FOREIGN PATENT DOCUMENTS

| | | | |
|---|---|---|---|
| 201073 | 11/1986 | European Pat. Off. | 299/92 |
| 2105768 | 3/1983 | United Kingdom | 299/79 |
| 2109438 | 6/1983 | United Kingdom | 299/79 |

OTHER PUBLICATIONS

K178 Systems, Kennametal Inc., Jan. 1988, p. 3.
K180S System, Kennametal Inc., Jan. 1988, front page.

*Primary Examiner*—Jerome W. Massie, IV
*Assistant Examiner*—David J. Bagnell
*Attorney, Agent, or Firm*—Thomas R. Trempus

[57] ABSTRACT

A retainer for rotatably retaining a mining tool or a wear resistant sleeve in a support block includes a removable collar consisting of at least two semiannular members each having a flange extending from its inside diameter and a groove disposed about its outside diameter. The removable collar is circumferentially mountable about a rearward portion of either the mining tool or the wear resistant sleeve extending from the support block when mounted therein. The extending rearward portion has a groove circumferentially disposed therein. When the semiannular members are mated thereabout, the flange of each member cooperates with the groove in the rearward portion of either the mining tool or the wear resistant sleeve. The groove about each semiannular member defines in combination a substantially continuous groove about the collar. A snap ring is removably mounted in the substantially continuous groove about the removable collar.

30 Claims, 3 Drawing Sheets

RETAINER FOR ROTATABLE BITS

BACKGROUND OF THE INVENTION

The invention relates to rotatable bits, more particularly the invention provides a retainer mechanism for use with both rotatable bits directly mounted in support blocks as well as the wear sleeves used in combination with rotatable bits mounted in support blocks.

Various excavating tools and bits for use therewith are well known in the art. For example, pick type mining bits take the form of an elongated body, round in cross section and symmetrical across the central axis with a cylindrical supporting shank at one end and with the other end generally tapering inwardly to a point in which is mounted a cemented carbide wear resistant element. Such bits, it has been found, will rotate on their axis when properly supported. The rotation is preferably caused by the engagement of the bit with the work and has the advantage of distributing the wear about the periphery of the bit. As a result, the life of the bit is substantially lengthened while the point end of the bit remains sharp.

The portion of the bit immediately rearwardly of the point is usually conical and, as the bit is used and rotates in use, the body of the bit adjacent the hard cemented carbide insert wears away so that the carbide insert remains exposed In connection with the rotation of the bit in the holder, the bit and holder comprise cooperating, inclined or conical shoulder areas, and these shoulder areas are subjected to substantial loads as the bit is used. Because of the loads involved, the shoulders sometimes wear relatively rapidly. With the bit itself, relatively rapid wear of the shoulder is not particularly important because, at worst, it will not wear away nearly as rapidly as the working point end thereof. Support for the bit, however, is in the form of a block which is usually welded in place on the drive machine and rapid wear of the shoulder on the block is a serious problem because the block is normally expected to remain in good condition for the life of several bits.

It has been found that the use of a metal wear sleeve which supports the shank of the bit while itself, in turn, is supported within the support block has substantially eliminated this problem. Various configurations of support blocks and sleeves are known in the art. An example of this can be found in Reissue U.S. Pat. No. 29,900, which is assigned to the assignee of the present invention and which is incorporated herein by reference.

While such tools operate in a highly efficient manner, it is nevertheless the case that, in at least certain formations, the tool is exposed to nonuniform impact conditions when working. These conditions result in a tendency for the tool to be subjected to a widely varying load in the axial direction with the tool even tending at times to be thrust forwardly or to tend to jump forwardly in the supporting block.

The tools are normally retained in the blocks by snap rings or the like mounted on the tool shank at the rear end of the block and, while snap rings are effective for retaining tools in the block, the aforementioned operating conditions cause the snap ring to engage the back of the block and to wear off the back of the block to the point that the tools develop a substantial amount of freedom of movement in the axial direction in the support block provided therefor. A variety of keeper arrangements are known in the art and are used to retain the cutting tool within the block or the wear sleeve within the block. Examples of this can be seen in U.S. Pat. Nos. 3,830,321 and 3,820,848, both of which are assigned to the assignee of the present invention and incorporated herein by reference.

With the foregoing in mind, it is a primary object of the present invention to provide an improved mining tool of the nature referred to in which the problems referred to above are substantially diminished.

Another object of the invention is the provision of a keeper arrangement for retaining a rotary mining tool in a support block which substantially eliminates erratic axial movements of the tool in the block.

It is yet another object of the invention to provide a keeper arrangement for retaining a rotating wear sleeve in a support block.

It is yet another object of this invention to provide the combination of a mining tool support block and keeper arrangement therefor for retaining the tool in the block in which substantially all of the relatively movable surfaces of the tool and block are protected from fine abrasive material developed during working operations.

It remains another object of this invention to provide keeper arrangement which facilitates both the installation and removal of mining bits and wear sleeves from support blocks.

SUMMARY OF THE INVENTION

In a first embodiment, the invention provides a means for rotatably retaining a wear resistant sleeve in a bit support block. The sleeve has a forward end adapted to receive a mining tool bit means therein and a rearward end which extends from the support block when said sleeve is mounted therein. The mining tool bit is retained within the wear resistant sleeve by separate keeper means.

The rearward portion of the sleeve has a groove circumferentially disposed therein, and a sleeve retainer means for rotatably and removably retaining the sleeve in the support block. The sleeve retainer comprises a removable collar means consisting of at least two semiannular members each having a flange extending from its inside diameter and a groove disposed about its outside diameter. The sleeve retainer means is circumferentially mountable about the sleeve rearward end such that each collar means flange engages the sleeve groove and each collar means groove defines in combination a substantially continuous groove about the collar means. The snap ring means is removably mounted about the removable collar means in substantially continuous groove.

In an alternative embodiment, the invention provides a mining tool retainer means for rotatably securing a mining tool bit in a bit support block. The retainer comprises a removable collar means consisting of at least two semiannular members each having a flange extending from its inside diameter and a groove disposed about its outside diameter. The retainer is circumferentially mountable about a rearward end of the mining tool which rearward end extends from the support block when the mining tool is mounted therein. The extending rearward portion of the mining tool has a groove circumferentially disposed therein, such that the collar means flange engages the sleeve groove and each collar means groove defines in combination a substantially continuous groove about the collar means. A snap ring means is removably mounted about the removable collar means in the substantially continuous groove.

BRIEF DESCRIPTION OF THE DRAWINGS

The above as well as other features and advantages of the present invention will become more apparent upon reference to the following detailed description of the invention taken in connection with the accompanying drawings in which.

DETAILED DESCRIPTION OF THE INVENTION

Figure 1:
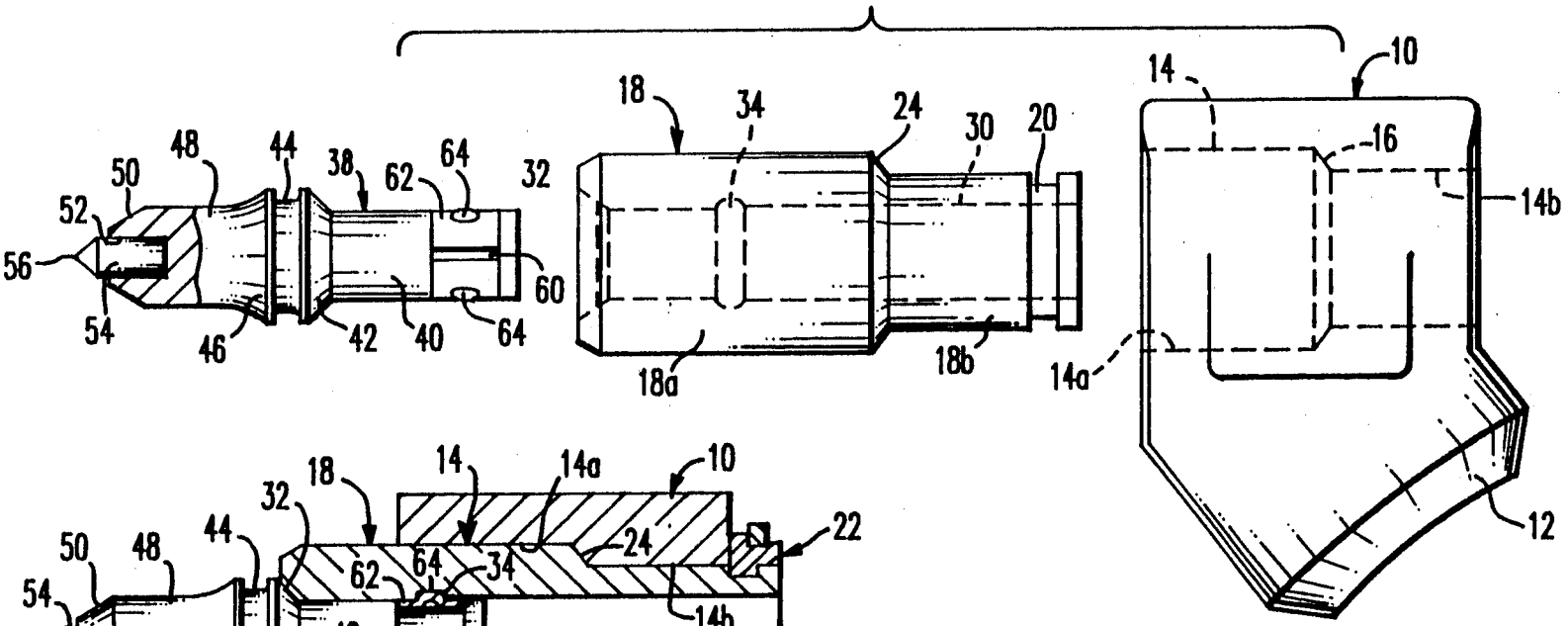
FIG. 1 is an exploded side elevational view illustrating a bit arrangement and support therefor according to one embodiment of this invention.
Figure 2:
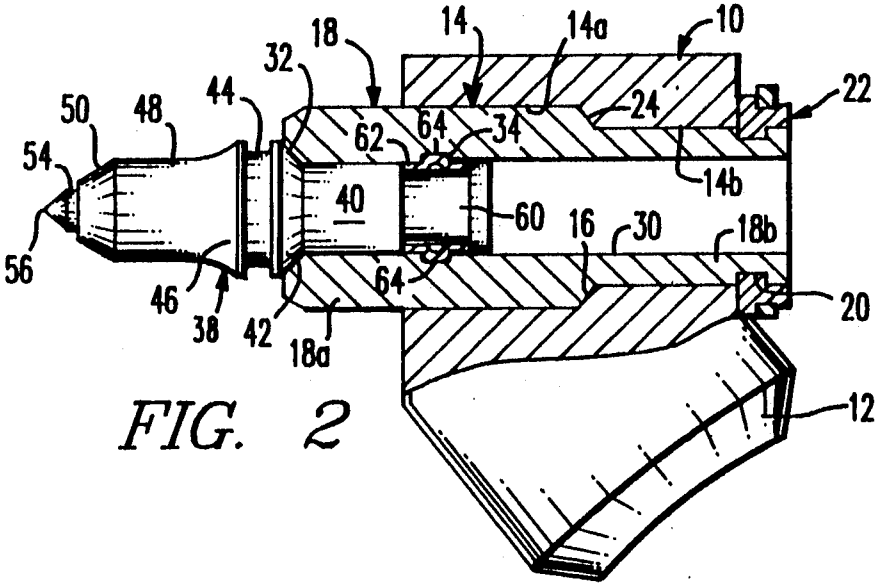
FIG. 2 is a side elevational view partly in section of the bit and supporting arrangement of this invention.

Turning now to FIGS. 1 and 2, it can be seen that the arrangement comprises a support block 10, a hardened metal sleeve 18 and a bit 38. The block 10 which may be a forging is adapted for being secured to a support member as by welding. It will be noted that the block 10 comprises a curved lower portion 12 which adapts the block for welding to the surface of a drum or the like, but it will be understood that the block could be shaped for mounting on a chain link or any other suitable supporting and driving device.

Block 10 has a shoulder bore 14 extending therethrough with a larger forward portion 14*a* and a smaller rearward portion 14*b* which are interconnected by a forwardly facing incline seat region 16. Seated in bore 14 is a hardened metal sleeve 18 comprising a large forward portion 18*a* which rotatably fits in bore portion 14*a* and a smaller diameter rearward portion 18*b* which rotatably fits in bore portion 14*b*. Portion 18*b* extends out the back of the block and has a groove 20 therein in which the retainer member, generally indicated by the reference numeral 22, is mounted. The forward portion 18*a*, in another embodiment not illustrated herein, can include a shoulder portion which engages the front face of the block 10.

Joining portions 18*a* and 18*b* of the metal sleeve is an inclined region 24 which fits against inclined region 16 of bore 14. The arrangement is such that the sleeve 18 is held in block 10 with a slight degree of freedom of axial movement therein so that the sleeve is relatively freely rotatable in the block. The sleeve 18 has a central bore 30 which at the forward end has a flared out seat 32. Spaced rearwardly from the seat 32 in bore 30 is an annular recess or undercut bore groove 34.

The bit 38 comprises a rearward cylindrical shank 40 having at its one end a flared out seat region 42 adapted for engagement with seat region 32 at the forward end of bore 30. These flared out seat regions form cooperating elements of abutment means between the bit 38 and sleeve 18. Forward of the seat region 42, the bit body has an annular groove 44 therein which is for the purpose of receiving a tool for removing the bit from the support when it is to be changed. Forwardly of groove 44, the bit body tapers inwardly rapidly as shown at 46 and then has a substantially cylindrical region 48 which may be of about the same diameter as shank 40. Near the forward end of the bit, there is a frusto-conical portion 50. An axial bore 52 is provided extending inwardly into the frusto-conical end of the bit and seated in bore 52 and preferably retained therein by brazing is a tip element 54 of a hard material, preferably cemented tungsten carbide. Tip element 54 has a pointed end 56 which is a substantial continuation of the inclined wall of frusto-conical portion 50.

Shank portion 40 has an annular groove 60 formed therein in which is seated a split ring band 62 having dimples or protuberances 64 therein distributed about the periphery thereof. The groove 60 and the protuberances 64 are so located along the shank 40 that when the bit is pressed into bore 30, as shown in FIG. 2, the protuberances 64 will snap into annular groove 34 in bore 30 so as to retain the bit in assembled relation with sleeve 18. The keeper in the form of a spring band 62 will yield inwardly in groove 60 so as to permit the bit to be pushed into bore 30 and will then snap outwardly when the bit is completely seated in the bore. The keeper firmly retains the bit in sleeve 18 and permits a slight amount of axial movement in the bit in bore 30 so that the bit is not locked against seat region 32 and is freely rotatable in bore 30.

Figure 3:
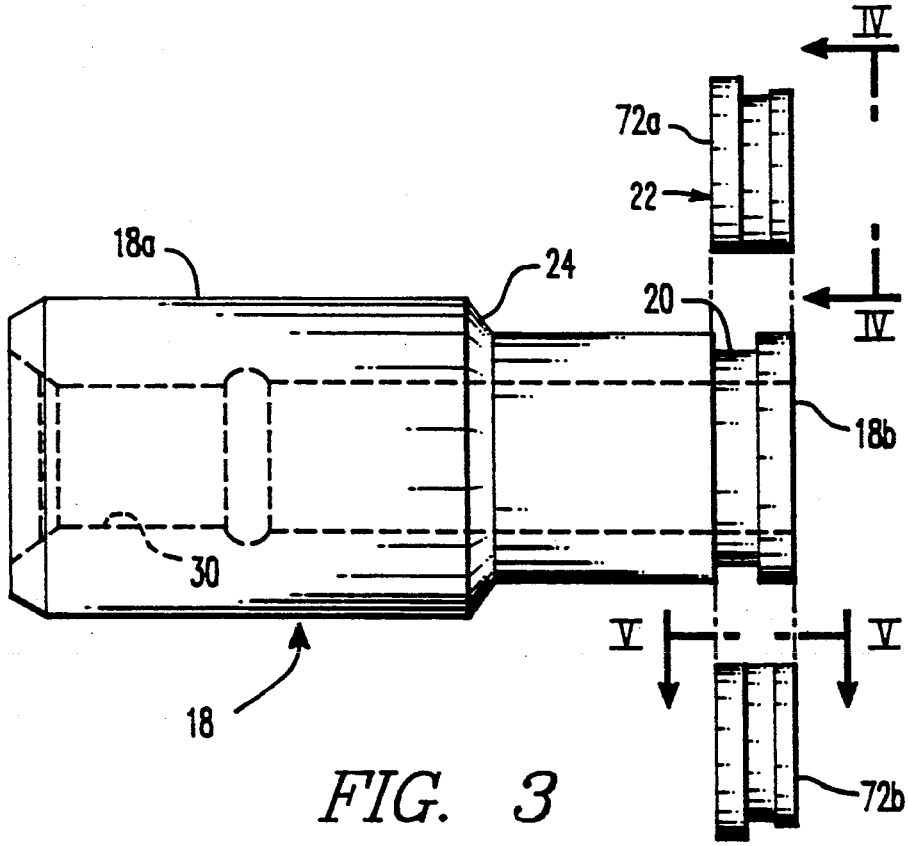
FIG. 3 is an exploded side elevational view of a wear sleeve and retainer.
Figure 4:
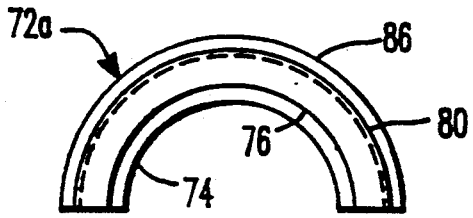
FIG. 4 is a view of the retainer member along lines IV—IV of FIG. 3.
Figure 5:
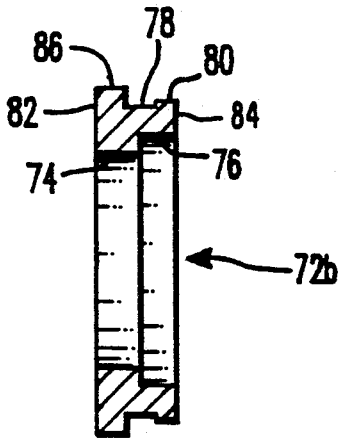
FIG. 5 is a view of the retainer member along lines V—V of FIG 3.
Figure 6:
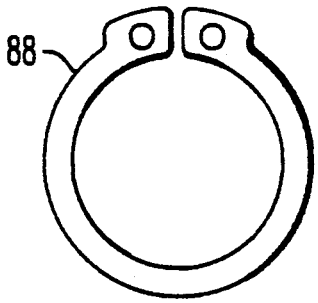
FIG. 6 is a perspective of the snap ring used with the retainer member.

Turning now to FIGS. 3 through 6, the removable retaining member can be more clearly seen. The exploded side elevational view in FIG. 3 shows the wear sleeve 18 and the retaining member 22 which consists of at least two removable collar means or semi-annular members 72*a* and 72*b*. As shown in FIGS. 4 and 5, each of the removable collar members 72*a* and 72*b* has a flange 74 extending from its inside diameter 76 and a groove 78 disposed about its outside diameter 80. Each collar member 72*a* and 72*b* further includes a forward face 82 and a rearward face 84. It can be seen in FIG. 3 that the depending flange 74 seats in the groove 20 disposed in the rearward portion 18*b* of the wear sleeve 18.

When the at least two collar members 72*a* and 72*b* are mounted about the rearward portion 18*b* of the wear sleeve 18, there is formed by the mated collar members a substantially continuous groove 78 thereabout. This groove or channel 78 provides a seat for the snap ring member 88. The snap ring can be easily mounted over the two collar members 72*a* and 72*b* by passage over the outside diameter 80 of the retainer member.

As can be most clearly seen in FIG. 5, the forward face 82 of the collar member is of a predetermined outside diameter which is selected to be slightly larger than the outside diameter of the rearward face 84 as indicated at the reference character 80. This outwardly projecting flange 86 on the forward face of the collar members 72*a* and 72*b* is of a size selected to substantially shield the snap ring member 88 (FIG. 6) when the snap ring member is mounted in the continuous groove 78 defined by the mated collar members.

The forward face 82 of the retainer means 22 is proximate the support block and acts to sustain axial thrusts in a direction imposed on the sleeve 18 during working operations. The snap ring 88 is of a conventional design and is well known in the art.

Returning briefly to FIG. 2, it can now be appreciated that the shoulder arrangement described in connection with the bit and the wear sleeve acts to sustain axial thrusts in a first direction or a rearward direction imposed on the sleeve during working operations. The retainer member 22 forward face 82 which is proximate the support block sustains axial thrusts in a second, generally forward direction which may be imposed on the sleeve or tool during working operations.

Figure 7:
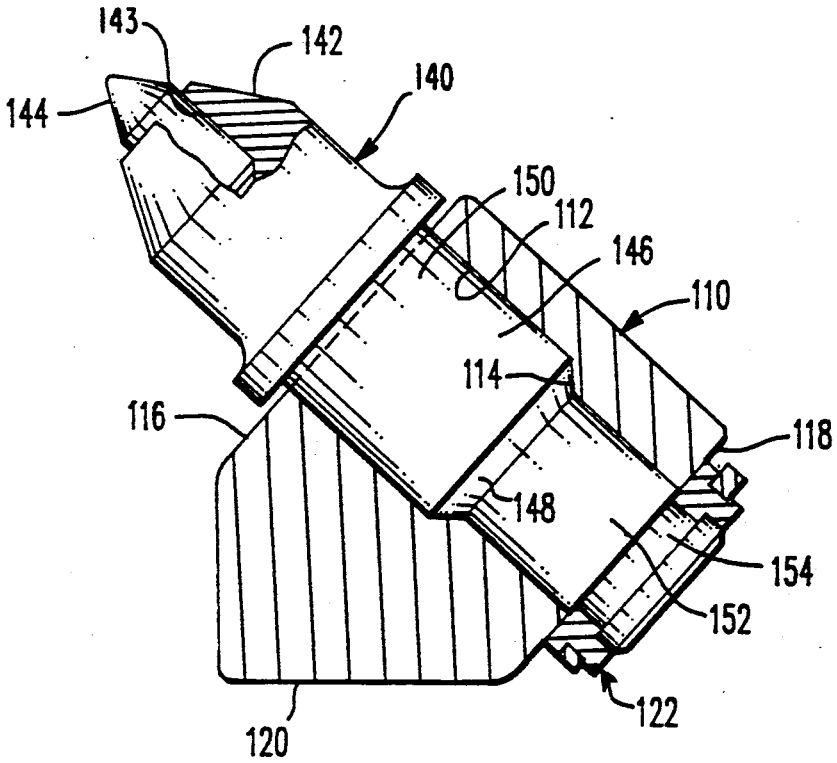
FIG. 7 is a side elevational view of a tool assembled with a support block and secured by a retainer, with the retainer and block in cross section and the tool partly broken away.

Turning now to FIG. 7, in an alternative embodiment, a support block 110 has a bore 112 extending therethrough with a forwardly facing inclined shoulder 114 formed in the bore intermediate the ends thereof. Block 110 has a forward face 116 and a rearward face 118 with each face at least in the region thereof surrounding the ends of the bore 112 being perpendicular to the axis of the bore. Block 110 also has lower portion 120 by means of which the block can be secured to a driver.

Mounted in bore 112 is a tool 140 which is generally symmetrical about its longitudinal axis. The forward end 142 of the tool 140 is the working region and tapers inwardly to a point. The forward end of the tool advantageously has an axial bore 143 therein in which is fixedly seated a hard wear resistant pointed element 144. The tool comprises a shank 146 which is circular in cross section at every point therealong and which is provided with a rearwardly facing shoulder 148 which abuttingly engages a shoulder 148 formed in the bore 112 of the block 110.

The forward portion 150 of the shank is at one diameter and the rearward portion 152 is at a lesser diameter and immediately behind the rear wall of the block the rearward portion of the shank of the tool which protrudes therefrom is formed with an annular groove 154 therein. Seated in the annular groove is the retaining means 122 which is adjacent to or in engagement with the rearward face of the block.

The retainer member 122 as used in conjunction with the shank of the bit as shown in FIG. 7 functions in accordance with the description thereof as provided in conjunction with FIGS. 1 through 6 in which the retainer member 22 is described in use with the wear sleeve.

What has been described is an improved retainer for use with both rotatable bits and wear sleeves which are used in combination with rotatable bits and support blocks.

What is claimed is:

1. In combination: a support block having a bore therethrough adapted to receive in said bore a sleeve of wear resistant material rotatably mounted therein, said sleeve having a forward end adapted to receive a bit means therein and a rearward end extending from said support block when said sleeve is mounted in said support block, said extending rearward portion of said sleeve having a groove circumferentially disposed therein, and a sleeve retainer means for rotatably and removably retaining said sleeve in said support block, said sleeve retainer comprising removable collar means consisting of at least two semiannular members each having a forward face, a flange extending from its inside diameter and a groove disposed about its outside diameter, said forward face defining at least in part said semiannular members' outside diameter which is greater than said sleeve's outside diameter, said sleeve retainer means being circumferentially mountable about said sleeve rearward end such that each said collar means flange engages said sleeve groove and each said collar means groove defines in combination a substantially continuous groove about said collar means and said collar means forward face is proximate said support block; and snap ring means removably mounted about said removable collar means in said substantially continuous groove.

2. The combination according to claim 1, wherein the sleeve and the support block have engaging shoulders thereon for sustaining axial thrusts in a first direction imposed on said sleeve during working operations, said shoulder on said sleeve facing away from said forward end of said sleeve.

3. The combination according to claim 2, wherein retainer means includes a rearward face and wherein said forward face is proximate the support block for sustaining axial thrusts in a second direction imposed on said sleeve during working operations.

4. The combination according to claim 3, wherein said bore in said block has a larger end part and a smaller end part remote therefrom and said shoulder on said support block is at the juncture of said parts of said parts of said bore, and said sleeve has a larger end part nearest the forward end thereof and a smaller end parts at the rearward end thereof, rotatably fitting the larger and smaller end parts respectfully of said bore, the shoulder on said sleeve being formed at the juncture of the respective end parts thereof.

5. The combination according to claim 4, wherein the sleeve shoulder tapers outwardly toward the forward end of said sleeve.

6. The combination according to claim 1, further including a bit means having a cylindrical shank at one end and tapering in at the other end, said shank being receivable in the forward end of the sleeve and being rotatable therein whereby said shank in the sleeve is partially axially coextensive with the support block bore.

7. The combination according to claim 6, wherein said bit comprises a flared seat at the juncture of the shank of the bit with the other end of the bit and wherein said sleeve has a flared region engaged by said seat.

8. The combination according to claim 7, wherein said sleeve inside surface has an integral groove past which the shank extends when the bit is mounted in the sleeve and keeper means engage the shank and groove and releasably retain the shank in the sleeve.

9. The combination according to claim 8, wherein the keeper means is resilient so that the bit can be pried out of the sleeve and forced into the sleeve.

10. The combination according to claim 9, wherein the shank has an annular recess and the keeper means is mounted in the recess and is captive on said shank.

11. The combination according to claim 10, wherein the keeper means is in the form of a spring band.

12. A sleeve retainer means for rotatably retaining a sleeve, in a mining tool support block, said sleeve retainer comprising removable collar means comprising of at least two semiannular members each having a forward face, a flange extending from its inside diameter and a groove disposed about its outside diameter, said forward face defining at least in part said semiannular members' outside diameter which is greater than said sleeve's outside diameter, said sleeve retainer means being circumferentially mountable about a rearward end of said sleeve which rearward end extends from said support block when said sleeve is mounted in said support block, said extending rearward portion of said sleeve having a groove circumferentially disposed therein, such that each said collar means flange engages said sleeve groove and each said collar means groove defines in combination a substantially continuous groove about said collar means and said collar means forward face is proximate said support block; and snap ring means removably mounted about said removable collar means in said substantially continuous groove.

13. The sleeve retainer means according to claim 12 wherein the support block has a bore therethrough and is adapted to receive the sleeve in the bore while permitting rotation of the sleeve in the bore.

14. The sleeve retainer means according to claim 13, wherein the sleeve and the support block have engaging shoulders thereon for sustaining axial thrusts in a first direction imposed on said sleeve during working operations, said shoulder on said sleeve facing away from said forward end of said sleeve.

15. The sleeve retainer means according to claim 14, wherein the retainer means includes a rearward face and wherein said forward face is proximate the support block for sustaining axial thrusts in a second direction imposed on said sleeve during working operations.

16. The sleeve retainer means according to claim 15, wherein said bore in said block has a larger end part and a smaller end part remote therefrom and said shoulder on said support block is at the juncture of said parts of said parts of said bore, and said sleeve has a larger end part nearest the forward end thereof and a smaller end parts at the rearward end thereof, rotatably fitting the larger and smaller end parts respectfully of said bore, the shoulder on said sleeve being formed at the juncture of the respective end parts thereof.

17. The sleeve retainer means according to claim 16, wherein the sleeve shoulder tapers outwardly toward the forward end of said sleeve.

18. The sleeve retainer means according to claim 13, wherein the sleeve further includes a forward end adapted to receive a bit means therein and wherein the bit means comprises a cylindrical shank at one end and tapers in at the other end, said shank being receivable in the forward end of the sleeve and being rotatable therein whereby said shank in the sleeve is partially axially coextensive with the support block bore.

19. The sleeve retainer means according to claim 18, wherein said bit comprises a flared seat at the juncture of the shank of the bit with the other end of the bit and wherein said sleeve has a flared region engaged by said seat.

20. The sleeve retainer means according to claim 19, wherein said sleeve inside surface has an integral groove past which the shank extends when the bit is mounted in the sleeve and keeper means engage the shank and groove and releasably retain the shank in the sleeve.

21. The sleeve retainer means according to claim 20, wherein the keeper means is resilient so that the bit can be pried out of the sleeve and forced into the sleeve.

22. The sleeve retainer means according to claim 21, wherein the shank has an annular recess and the keeper means is mounted in the recess and is captive on said shank.

23. The sleeve retainer means according to claim 22, wherein the keeper means is in the form of a spring band.

24. In a mining tool; a tool body having a longitudinal axis and symmetrical about said axis, said tool having a working region on said axis at the forward end tapering to a point and a shank on said axis at the rearward end, said shank being circular in cross section and of a first dimension, rearwardly facing shoulder means formed on said shank in the region thereof between the forward end of said shank and a point about midway of the length of the shank for supporting the tool body during working operations, said shank being formed with a groove near the rear end, and a retainer means comprising removable collar means consisting of at least two semiannular members each having a forward face, a flange extending from its inside diameter and a groove disposed about its outside diameter, said forward face defining at least in part said semiannular members' outside diameter which is greater than said shank's first dimension, said retainer means being circumferentially mountable about said shank rearward end such that each said collar means flange engages said shank groove and each said collar means groove defines in combination a substantially continuous groove about said collar means; and snap ring means removably mounted about said removable collar means in said substantially continuous groove and wherein the forward face outside diameter substantially shields the snap ring means mounted in the groove.

25. The mining tool according to claim 24 in which the working region of said tool body comprises a tapered forward end on said body which terminates in a point located on said longitudinal axis and said point is formed by an element of hard wear resistant material embedded in the tapered forward end of said body.

26. The mining tool according to claim 25 further including a support block having a front face and a rear face and a bore extending through the block and also through said front and rear faces, said bore being adapted to receive said shank from the forward end of the bore, said block having a forwardly facing shoulder engaging the rearwardly facing shoulder on said shank for sustaining axial thrusts in a first direction imposed on the tool body during working operations, the rearward end of said shank protruding from the rearward end of said bore and said groove being disposed immediately rearwardly of the rear face of said block when the shoulder on said shank engages the shoulder on said block, and wherein the retainer means includes a rearward face and wherein said forward face is proximate the support block for sustaining axial thrusts in a second direction imposed on said sleeve during working operations.

27. The mining tool according to claim 26 wherein the rearward face of the block in at least the region thereof adjacent to and surrounding the bore is perpendicular to the axis of the bore.

28. A mining tool retainer means for rotatably retaining a mining tool in a support block bore having forward and rearward ends, with at least said rearward end being of a first diameter, said retainer comprising removable collar means consisting of at least two semiannular members each having a forward face, a flange extending from its inside diameter and a groove disposed about its outside diameter, said forward face defining at least in part said semiannular members' outside diameter which is greater than said support block bore's rearward end's first diameter, said retainer means being circumferentially mountable about a rearward end of said mining tool which rearward end extends from said support block when said mining tool is mounted in said support block bore's rearward end, said extending rearward portion of said mining tool having a groove circumferentially disposed therein, such that each said collar means flange engages said groove in said extending rearward portion of said mining tool and each said collar means groove defines in combination a substantially continuous groove about said collar means; and snap ring means removably mounted about said removable collar means in said substantially continuous groove.

29. The mining tool retainer means according to claim 28, wherein the retainer means includes a forward face and a rearward face and wherein said forward face is proximate the support block for sustaining axial thrusts imposed on said mining tool during working operations.

30. The mining tool according to claim 29 wherein the forward face of the retainer means is of a predetermined outside diameter selected to substantially shield the snap ring means mounted in the groove defined by the retainer means.

* * * * *